US007255288B2

(12) United States Patent
Chan

(10) Patent No.: US 7,255,288 B2
(45) Date of Patent: Aug. 14, 2007

(54) AROMA THERAPY FOR FOUNTAIN

(76) Inventor: Wan Shan Chan, 601 Monterey Pass Rd., Monterey Park, CA (US) 91754

( * ) Notice: Subject to any disclaimer, the term of this patent is extended or adjusted under 35 U.S.C. 154(b) by 693 days.

(21) Appl. No.: 10/796,399

(22) Filed: Mar. 8, 2004

(65) Prior Publication Data

US 2005/0194459 A1 Sep. 8, 2005

(51) Int. Cl.

| | |
|---|---|
| ***E03B 9/20*** | (2006.01) |
| ***B05B 17/08*** | (2006.01) |
| ***B05B 12/14*** | (2006.01) |
| ***A24F 25/00*** | (2006.01) |

(52) U.S. Cl. ..... 239/16; 239/17; 239/23; 239/24; 239/34; 239/54; 239/55

(58) Field of Classification Search ..... 239/16, 239/17, 23, 24, 34, 54, 55, 60, 128
See application file for complete search history.

(56) References Cited

U.S. PATENT DOCUMENTS 5,477,640 A * 12/1995 Holtkamp, Jr. ..... 47/66.6
5,827,483 A * 10/1998 Fullam ..... 422/122
6,029,899 A * 2/2000 Walker ..... 239/17
6,371,453 B1 * 4/2002 Hunter ..... 261/107
6,439,471 B2 * 8/2002 Ehrlich et al. ..... 239/18
6,443,364 B1 * 9/2002 Lin ..... 239/17

* cited by examiner

*Primary Examiner*—David D. Hwu
(74) *Attorney, Agent, or Firm*—Raymond Y. Chan; David and Raymond Patent Group

(57) ABSTRACT

An aroma therapy for fountain comprises a fountain assembly, which comprises a water container having a bottom, a top opening and an interior, a aroma supporting member for support an aroma therapy dispensing unit, comprising a heating source adapted to generate a heat, a bowl adapted for reserving an aromatic substance therein, a base stand detachably and securely mounted on the aroma supporting member for holding the heat source, and a plurality of supporting frame extended upwardly from the base to securely sustain the bowl, such that the heat generated from the heating source disposed beneath the bowl could heat the bowl thereby diffusing the aromatic substance reserved in the bowl volatized into surrounding air.

20 Claims, 4 Drawing Sheets

AROMA THERAPY FOR FOUNTAIN

BACKGROUND OF THE PRESENT INVENTION

1. Field of Invention

The present invention relates to an aroma therapy for fountain, more particularly, relates to an aroma therapy dispenser which is disposed within a water pool to be incorporated with a fountain for soothing user's mood.

2. Description of Related Arts

Nowadays, people are highly aware of their living environment, especially people living an urban area have devoted much enthusiasm for decorating their houses and offices. Sometimes, to make their surrounding naturally and lively, many people employ fountains to enrich the overall decorative appearance. This is due to the fact that fountains not only pose a nice appearance, but also provide a sound of flowing water which is capable of effectively soothing user's mood. What is more, a fountain enables the associated water pool as a water flowing function, which is essential to raise petting fishes. Therefore, the traditionally outdoor used fountains have been redesigned with a suitable size and dimension adapted for being used inside the house and office. In other words, the structure and function of indoor used fountain is appropriate for being disposed in a relatively small space to improve the indoor living and studying environment. More importantly, the naturally flowing water provided by the fountain change a water pool into a desirable place for fishes' survival, and simultaneously, could humidifies the indoor air thereby moisturizing the living environment.

The aroma therapy dispenser is widely used for emitting scents for assisting user's relaxing as well as soothing user' mood. For those users who have been suffering the stress, the aroma scent dispenser is absolutely a good relieving option, which has been proven for impacting both physical and mental system of the user.

Presently, those aroma therapy dispensers available on the market commonly comprise a base, a supporting frame, and a container, wherein a heating source is disposed beneath the container carrying the therapy liquid. There are a number of known devices being used as the heating source, such as heat from candles, burners, electromagnetic tubes or light bulbs to disperse aromatic oils or other aromatic substances volatile into surrounding air.

However, since the container for carrying the aromatic substance is directly positioned above the heat source, the overheating of the aromatic substance and supporting frame is unavoidable, which could probably cause some accidents burning the surrounding objects. Meanwhile, if the user's hand carelessly touch the container carrying the aromatic substance, the unnecessary scald injury is irritating too. It is envisioned if the aromatic substance as well as its hearing source could be disposed within a water pool, all safety concerns will be automatically disappeared. Until now, there is no such aroma therapy dispenser incorporated with a water pool available on the market.

In other words, water pool fountains and aroma therapy dispenser exist separately for performing some function to serve people who were intending to use both of them. Therefore, there existed an optimistic chance for a personal water fountain, which is aesthetically designed and embodied with aromatic benefits offered by aroma therapy dispenser, to be successful in the market. Such kind of fountain style aroma therapy dispenser is inherently equipped with fire-controlling function, and simultaneously, is capable of delivering scents, moisturizing air, and providing natural water flowing sound.

SUMMARY OF THE PRESENT INVENTION

A primary object of the present invention is to provide an aromatic therapy for fountain which is capable of diffusing the aromatic substance into surrounding air by a heating source.

Another object of the present invention is to provide an aromatic therapy for fountain, wherein the heating source for diffusing the aromatic substance is disposed within a water pool so as to prohibit any undesirable fire hazard and prevent user from scalding injury.

Another object of the present invention is to provide an aromatic therapy for fountain, wherein the water fountain incorporated with the aromatic substance dispenser as well as its heating source is aesthetically designed.

Another object of the present invention is to provide an aromatic therapy for fountain, wherein the water fountain incorporated with the aromatic substance dispenser as well as its heating source is associated with fountain's functional features, so as to provide naturally flowing water as an aquarium for rising fishes and at the same time providing water flowing sounds.

Another object of the present invention is to provide an aromatic therapy fountain, wherein the diffusion of the aromatic substance is moisturized with flowing water of the fountain so as to provide a humidified aromatic effect.

Another object of the present invention is to provide an aromatic therapy fountain, wherein the base adapted for containing the aromatic substance as well as its heating source is floatable on the water within the fountain thus substantially reducing the overheating risks of heating source holder.

Another object of the present invention is to provide an aromatic therapy fountain, wherein no complicated structure and expensive parts are used.

Accordingly, to accomplish the above mentioned objects, the present invention provides an aroma therapy for fountain, comprising:

A fountain assembly, which comprises a water container having a bottom, a top opening and an interior, wherein an elongated hollow member is extended upwardly from the bottom to a predetermined distance well above the top opening, said elongated hollow member has a top water outlet and bottom water inlet positioned close to the bottom of the container;

A pump disposed within the interior for pumping water flow upward through the elongated hollow member from the bottom water inlet to the top water outlet, then weight down to generate fountain effect;

A upright aroma supporting member extended from the bottom of the container wherein a recessed mounting cavity is provided on the enlarged top end of the aroma supporting member;

An aroma therapy dispensing unit, comprising:

A heating source adapted to generate a heat;

A bowl adapted for reserving an aromatic substance therein;

A base stand detachably and securely mounted on the aroma supporting member for holding the heat source; and A plurality of supporting frame extended upwardly from the base to securely sustain the bowl, such that the heat generated from the heating source disposed beneath the bowl could heat the bowl thereby diffusing the aromatic substance reserved in the bowl volatized into surrounding air.

These and other objectives, features, and advantages of the present invention will become apparent from the following detailed description, the accompanying drawings, and the appended claims.

DETAILED DESCRIPTION OF THE PREFERRED EMBODIMENT

Figure 1:
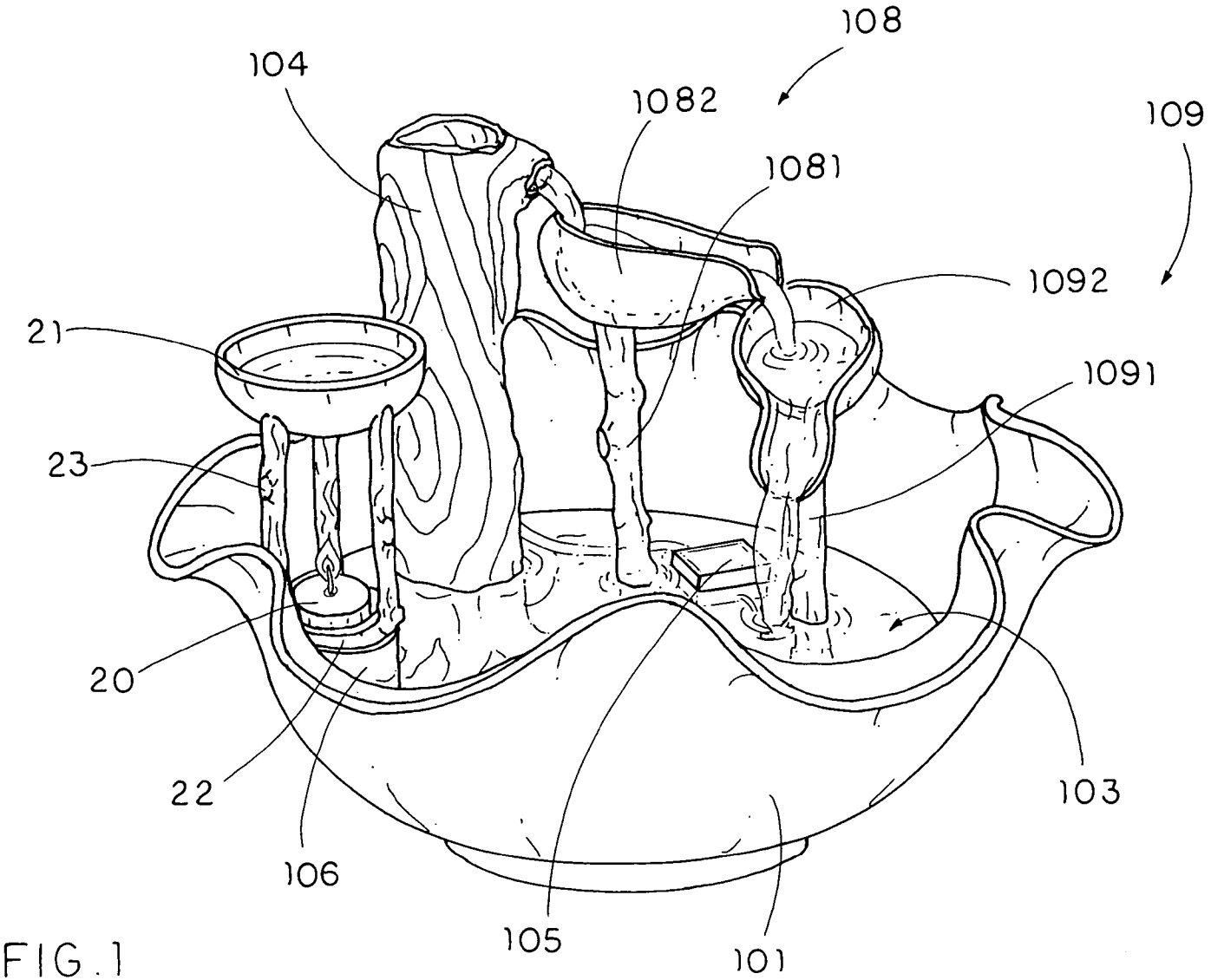
FIG. 1 is a perspective view of the aroma therapy for fountain according to the first embodiment of the present invention.

Referring to the FIG. 1, the aroma therapy delivering system according to the first embodiment of the present invention is illustrated.

The fountain assembly 1 comprises a container 10 for reserving a liquid like water, wherein the container 10 has a curved bottom 101, a top opening 102 and an interior 103. An elongated hollow member 104 is extended upwardly from the bottom 101 to a predetermined distance well above the top opening 102; said elongated hollow member 104 has a top water outlet and bottom water inlet positioned close to the bottom 101 of the container 10.

A pump 105 is disposed within the interior 103 for pumping water flow upward through the elongated hollow member 104 from the bottom water inlet to the top water outlet, then weight down to generate fountain effect.

For some aesthetical and sounding effects perspectives, a first piling member 108 and a second piling member 109 are provide within the interior 103 of the container 10 for enriching some appearing and sounding effects. The first piling member 108 include a supporting pillar 1081 and a shovel shaped water carrier 1082 is affixed on the top end of the supporting pillar 1081, wherein the rear portion of shovel shaped water carrier 1082 is closed to the top outlet of the elongated hollow member 104, in such way the water flow out from the top outlet of the elongated hollow member will weight down to the shovel shaped water carrier 1082. Meanwhile, the second piling member 109 has an identified structure with the first piling member 108 except its shorter supporting pillar. Here, the rear portion of the shovel shaped water carrier 1092 is vertically aligned with the front portion of the shovel shaped water carrier 1082 of the first piling member 108. Thanks to the shovel structure, water weight down from the top outlet of the elongated hollow member will hit the water carrier 1082 first, and then, flow out from the front portion of the water carrier 1082, afterwards, weight down to the water carrier 1092, finally, flow into the container 10 as shown in FIG. 1. As a result, the present invention provides a three phase piling fountain having a better appearance and sounding effects.

An upright aroma supporting member 106 is extended from the bottom 101 of the container 10 wherein a recessed mounting cavity 1061 is provided on the enlarged top end of the aroma supporting member 106.

According to the present invention, the container 10, the elongated hollow member 104, and the aroma supporting member 106, the filing member 108,109 are made of rigid materials, such as porcelain, china, rigid plastics, stainless steel, rigid glasses and the like. The pump 105 is of submersed mode as used in an aquarium system for generating flowing water. The installation of pump for an indoor fountain has been well known to the arts, the present invention is emphasized on aroma dispensing unit.

The aroma therapy dispensing unit 2 comprises a heating source 20 adapted to generate a heat, a bowl 21 adapted for reserving an aromatic substance therein, a base stand 22 detachably and securely mounted on the aroma supporting member 106 for holding the heat source 20, and a plurality of supporting frame 23 extended upwardly from the base stand 22 to securely sustain the bowl 21 in place, such that the heat generated from the heating source 20 disposed beneath the bowl could heat the bowl 21 thereby diffusing the aromatic substance reserved in the bowl 21 volatized into surrounding air.

There are a lot of heat source available known to the art such as candle, burner, light bulb, electromagnetic element and like. The present invention employs the candle flame as the heating source 20.

Figure 2:
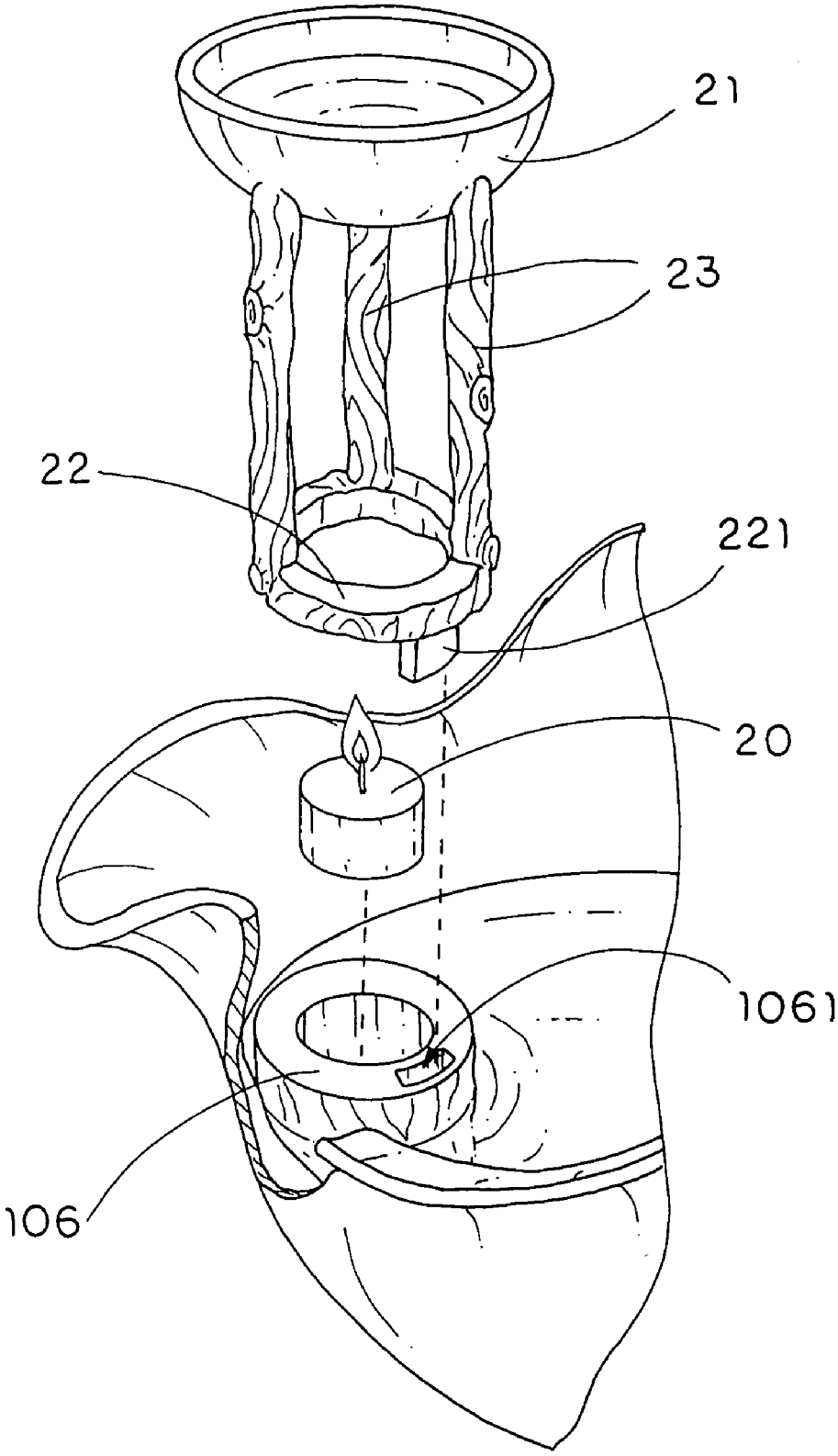
FIG. 2 is a partial enlarged perspective view of the aroma therapy for fountain according to the first embodiment of the present invention.
Figure 3:
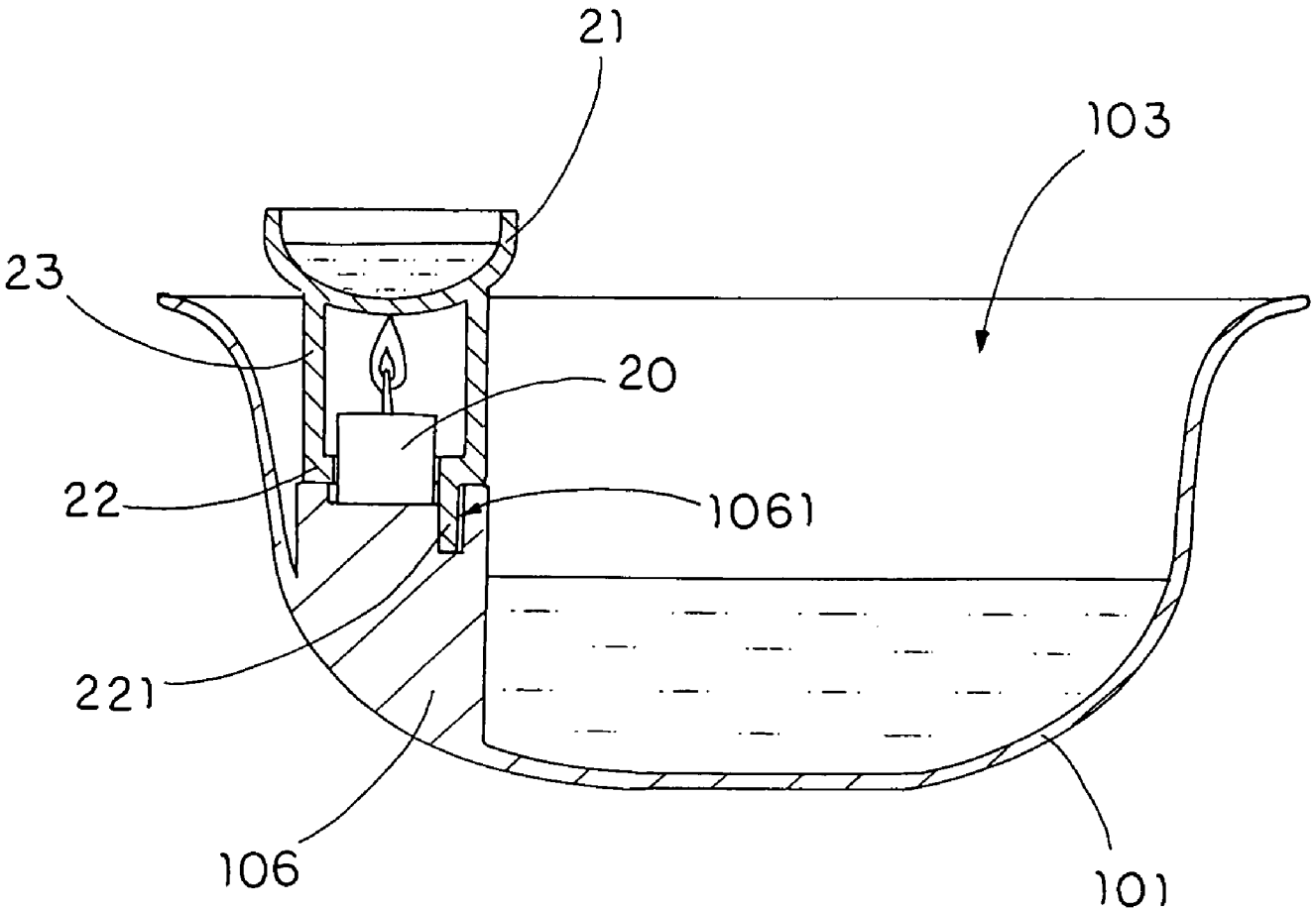
FIG. 3 is sectional view of the aroma therapy for fountain according to the first embodiment of the present invention showing the aroma dispensing unit.

Referring to the FIG. 2 and FIG. 3, the container 10 for housing the aroma therapy dispensing unit 2 includes a bottom 101 which is extended upwardly to define a circumferential outer wall forming the interior 103.

Below the bottom of the bowl is the burning wick of a candle 20, or any other heating means, like a burner. According to the first preferred embodiment, a candle flame is provided for heating the bottom of the bowl 21 functioned as a cooking pot in routine application. Anyway, the heating source is disposed beneath the bowl 21 to ensure a stable temperature for diffusing the aromatic substances carried therein. Here, the aromatic substance could be solid aromatic oil or any other similar substances which is adapted to be volatized into surrounding air.

Here, the bowl 21 for carrying the aromatic substances is adapted to be securely attached on the top ends of a plurality of supporting frame 23. And the candle 20 is supported on the base stand 22. Advantageously, the candle 20 could be made of aromatic materials such scent candle to strength the soothing effect of the fountain. It is noted that the candle 20 could be affixed to the top surface of the base stand 22 by any means known to the persons skilled in the art, such as an adhesive material.

It is noted that the base stand 22 adapted for mounting a standard scentless candle has a diameter slightly larger than the diameter of the candle 20. And the supporting frame 23 has a predetermined distance for ensuring the candle 20 having a wick could be ignited to have a flame to heat the bottom of the bottom of the bowl 21 with a desirable efficiency. The bowl is made of material having better heating conductive.

From a perspective view, the bowl 21 according to the first embodiment is just like being nested in a tree.

A protrusion 221 is extended from the base stand's bottom to be inserted into the recessed mounting cavity 1061 defined on the aroma supporting member 106 for detachably and securely mounting the base stand 22 on the aroma supporting member 106. As shown in FIG. 3, the base stand 22 could be mounted on the aroma supporting member 106 with one end of base stand just rested on the curved bottom 101 of the container 10.

It is worth to mention that the container 10 having a circumferential outer wall to define a water pool could be of any size capable of housing the aroma therapy dispensing unit 2 and fountain assembly 1. If the users wish to raise fishes inside the water pool, the container could be designed with a bigger size.

Figure 4:
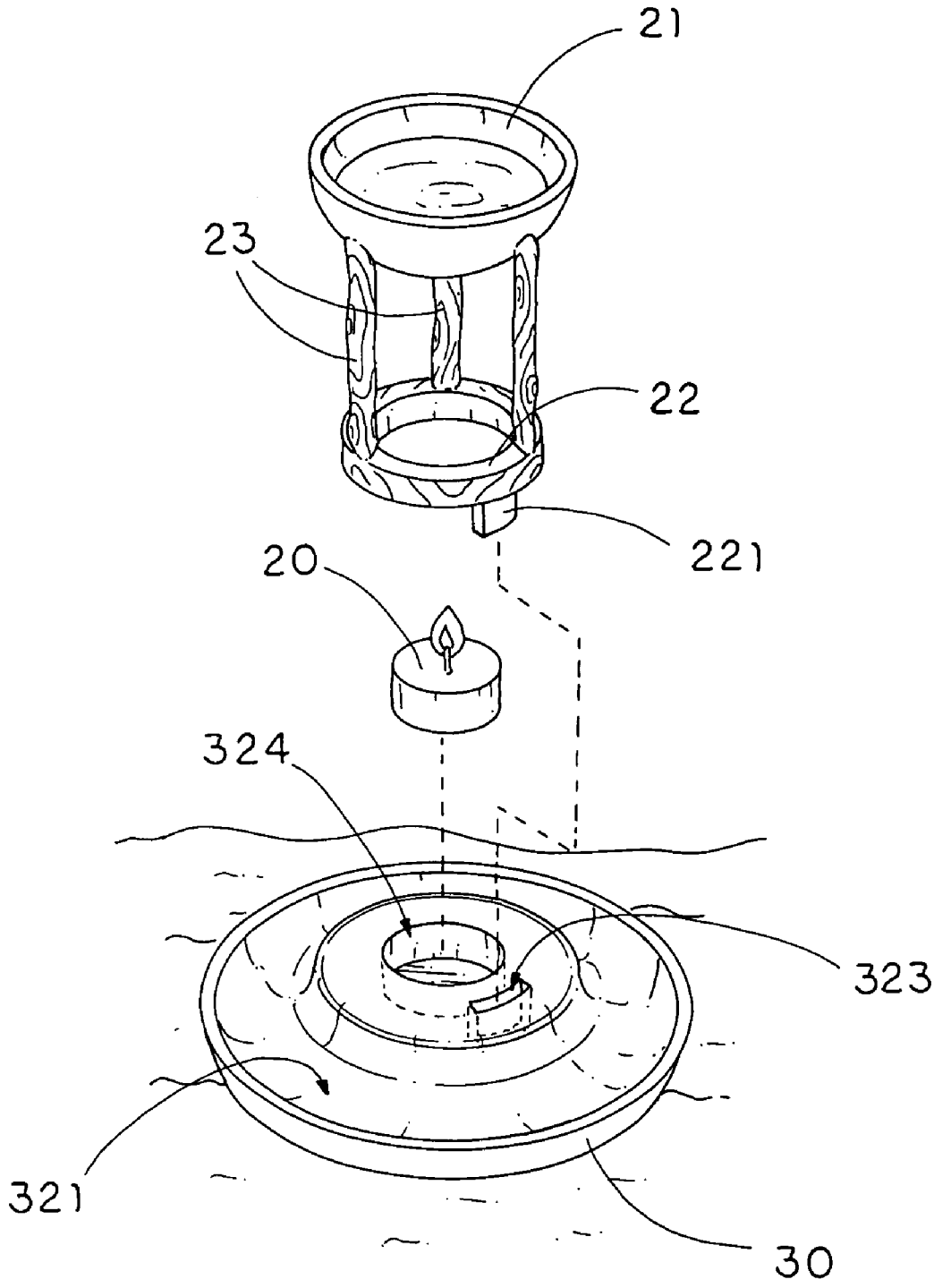
FIG. 4 is a perspective view of the aroma therapy for fountain according to the second embodiment of the present invention showing the aroma dispensing unit mounted on a floatable supporter.

Referring to the FIG. 4, a floatable supporter 30 for hosting the aroma therapy dispensing unit 2 according to the second embodiment of the present invention is illustrated. The floatable supporter 30 is shaped like a ship having a chamber for receiving an engaging mounting protrusion. And the floatable supporter 30 includes a cylindrical hollow supporter body 32 for ensuring it unsinkable when placed on the water surface. The hollow supporter body 32 comprises a top wall 321, wherein a top opening 324 is defined on the top wall of the hollow supporter body 32 to define a supporter chamber 31 to receiving an engaging member, or irreplaceably receiving a candle or a burner therein. Meanwhile, a circular rim is provided for encircling the top opening of the hollow body. and a curved mounting slots 323 is provided on the two side portions of the top wall 321 of the supporter body adapted to be engaged with the protrusion extended from the bottom of the base stand 22.

To attach the aroma therapy dispensing unit on the floatable supporter 30, user could align and insert the protrusion 221 extended from the bottom of the base stand 22 into the mounting slot 323 defined on the top wall 321 of the floatable supporter 30 for detachably and securely mounting the base stand 22 on the floatable supporter 30 in an interlock manner.

It is worth to mention that a replaceable candle or a burner could be disposed in the camber 31. Furthermore, the floatable supporter is made of materials with good heat conductivity and floated above the water surface, such that overheating concerns is out of consideration. Accordingly, the base stand 22 could be made of ring shaped in the second embodiment of the present invention.

By engaging the protrusion 221 with the mounting slot 323, the base stand 22 of the aroma therapy dispensing unit 2 will be seated on rim 12 of the supporter body 32, which is a cylindrical shell made of decorative glass, colorful plastics, or lightweight stainless metal for form a ship style supporter floatable within the water pool to enrich the overall entertainment effect.

It is noted that since the floatable supporter is floating on the water, so the heat caused by heating source could be dissipated as soon as possible thereby substantially reducing the risk of overheat burning and scald injury of user. Given the nature of a fountain, wherein the water is constantly flowing, so the floatable supporter is susceptible to be swift within the water pool. If the user is inclined to stabilize the movement of the floatable supporter 30, he could merely fasten the floatable supporter 30 to the outer wall of the container.

It is worth to mention that the fountain assembly 1 and aroma dispensing unit are all ascetically designed to generate craft or art products appearance. In the present invention, the bowl 21, the outlet of the elongate hollow member 104, the two piling supporting member 108, 109 are all cactus shaped with a purple color and the container 10 is designed with corrugated edge as shown in FIG. 1.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A water pool fountain aroma dispenser, comprising:

a water pool having a container adapted for holding a water, wherein said container has a bottom, a top opening, and in interior;

an aroma supporting member extended from said bottom of said container having an enlarged top end wherein a recessed mounting cavity is provided on said top end of said aroma supporting member;

an aroma therapy dispensing unit, which comprises:

a heating source adapted to generate a heat;

a bowl adapted for reserving an aromatic substance therein;

a base stand detachably and securely mounted on said aroma supporting member for holding said heating source; and a plurality of supporting frame extended upwardly from said base stand to securely sustain said bowl in place, such that said heat generated from said heating source disposed beneath said bowl is capable of heating said bowl thereby diffusing said aromatic substance reserved in said bowl volatized into surrounding air.

2. A water pool fountain aroma dispenser, as recited in claim 1, wherein said water pool further comprise:

a fountain assembly having an elongated hollow member extended upwardly from said bottom to a predetermined distance well above said top opening, wherein said elongated hollow member has a top water outlet and bottom water inlet positioned close to said bottom of said container for communicating with said water; and a pump disposed within said interior for pumping said water flow upward through said elongated hollow member from said bottom water inlet to said top water outlet, then weight down to generate a fountain effect.

3. A water pool fountain aroma dispenser, as recited in claim 2, wherein said fountain assembly further comprises at least a fountain member within said interior of said container, said fountain member includes a supporting pillar and a carrier having a rear portion vertically aligned with said top water outlet of said elongated hollow member in such way when said water flowing out from said top water outlet of said elongated hollow member will weight down into said rear portion of said carrier then flow out into said container to generate said fountain effect.

4. A water pool fountain aroma dispenser, as recited in claim 3, wherein said container, said elongated hollow member, said aroma supporting member, said fountain member are made of rigid materials.

5. A water pool fountain aroma dispenser, as recited in claim 4, wherein said pump is of submersed mode adapted for flowing said water.

6. A water pool fountain aroma dispenser, as recited in claim 4, wherein said base stand of said aroma therapy dispensing unit further has a bottom wherein a protrusion is extended thereon adapted to be inserted into said recessed mounting cavity defined on said aroma supporting member for detachably and securely mounting said base stand on said aroma supporting member.

7. A water pool fountain aroma dispenser, as recited in claim 6, wherein said heat source is a candle having a wick to generate a flame to heat said aromatic substance reserved in said bowl to be volatized.

8. A water pool fountain aroma dispenser, as recited in claim 7, wherein said supporting frame has a predetermined height for ensuring said flame generated by said candle touch said bowl.

9. A water pool fountain aroma dispenser, as recited in claim 2, wherein said pump is of submersed mode adapted for flowing said water.

10. A water pool fountain aroma dispenser, as recited in claim 2, wherein said base stand of said aroma therapy dispensing unit further has a bottom wherein a protrusion is extended thereon adapted to be inserted into said recessed mounting cavity defined on said aroma supporting member for detachably and securely mounting said base stand on said aroma supporting member.

11. A water pool fountain aroma dispenser, as recited in claim 10, wherein said heat source is a candle having a wick to generate a flame to heat said aromatic substance reserved in said bowl to be volatized.

12. A water pool fountain aroma dispenser, as recited in claim 11, wherein said supporting frame has a predetermined height for ensuring said flame generated by said candle touch said bowl.

13. A water pool fountain aroma dispenser, comprising:

a water pool having a container adapted for holding a water, wherein said container has a bottom, a top opening, and in interior;

an aroma therapy dispensing unit, which comprises:

a heating source adapted to generate a heat;

a bowl adapted for reserving an aromatic substance therein;

a base stand detachably and securely mounted on said aroma supporting member for holding said heating source; and a plurality of supporting frame extended upwardly from said base stand to securely sustain said bowl in place, such that said heat generated from said heating source disposed beneath said bowl is capable of heating said bowl thereby diffusing said aromatic substance reserved in said bowl volatized into surrounding air; and a floatable supporter for hosting said aroma therapy dispensing unit.

14. A water pool fountain aroma dispenser, as recited in claim 13, wherein said floatable supporter further comprises a hollow supporter body for ensuring said floatable supporter unsinkable, a chamber defined on said hollow supporter body for receiving said heating source, and a mounting slots provided on a top wall of said hollow supporter body.

15. A water pool fountain aroma dispenser, as recited in claim 14, wherein said base stand of said aroma therapy dispensing unit further has a bottom wherein a protrusion is extended thereon adapted to be inserted into said mounting slot defined on said top wall of said hollow supporter body.

16. A water pool fountain aroma dispenser, as recited in claim 15, wherein said heat source is a candle having a wick to generate a flame to heat said aromatic substance reserved in said bowl to be volatized.

17. A water pool fountain aroma dispenser, as recited in claim 16, wherein said supporting frame has a predetermined height for ensuring said flame generated by said candle touch said bowl.

18. A water pool fountain aroma dispenser, as recited in claim 14, wherein said heat source is a candle having a wick to generate a flame to heat said aromatic substance reserved in said bowl to be volatized.

19. A water pool fountain aroma dispenser, as recited in claim 18, wherein said supporting frame has a predetermined height for ensuring said flame generated by said candle touch said bowl.

20. A water pool fountain aroma dispenser, as recited in claim 13, wherein said heat source is a candle having a wick to generate a flame to heat said aromatic substance reserved in said bowl to be volatized.

* * * * *